United States Patent [19]

Shimono

[11] 4,390,046

[45] Jun. 28, 1983

[54] APPARATUS FOR MANUFACTURING WOVEN SLIDE FASTENER STRINGERS

[75] Inventor: Muchiji Shimono, Namerikawa, Japan

[73] Assignee: Yoshida Kogyo K.K., Tokyo, Japan

[21] Appl. No.: 240,584

[22] Filed: Mar. 4, 1981

[30] Foreign Application Priority Data

Mar. 25, 1980 [JP] Japan ..... 55-39388[U]

[51] Int. Cl.[3] ..... D03D 47/00

[52] U.S. Cl. ..... 139/442; 139/35; 139/116

[58] Field of Search ..... 139/11, 35, 116, 442

[56] References Cited

U.S. PATENT DOCUMENTS

| | | | |
|---|---|---|---|
| 3,827,463 | 8/1974 | Glindmeyer | 135/35 |
| 4,134,184 | 1/1979 | Motta | 139/442 |
| 4,278,111 | 7/1981 | Takahashi et al. | 139/442 |

*Primary Examiner*—Henry Jaudon

*Attorney, Agent, or Firm*—Hill, Van Santen, Steadman, Chiara & Simpson

[57] ABSTRACT

An apparatus for manufacturing woven slide fastener stringers comprises means for shedding a plurality of warp threads, a coiling mechanism for coiling a monofilament of synthetic resin around a mandrel in a conical orbit to form a series of coiled coupling elements and a weft inserter reciprocable across the warp shed and the conical orbit for inserting a weft thread into the warp shed, by which the coiled coupling elements can be woven into a stringer tape along a longitudinal edge thereof as the tape is woven of the warp and weft threads. The weft inserter includes an arm which when the weft thread is inserted is engageable with the monofilament to displace the latter out of the path of insertion of the weft thread so that the weft thread can be inserted smoothly without being frictionally engaged by the monofilament.

3 Claims, 5 Drawing Figures

APPARATUS FOR MANUFACTURING WOVEN SLIDE FASTENER STRINGERS

BACKGROUND OF THE INVENTION

1. Field of the Invention

The present invention relates to an apparatus for manufacturing a woven slide fastener stringer including a woven stringer tape and a coiled coupling element woven into the stringer tape along a longitudinal edge thereof.

2. Prior Art

A known apparatus for manufacturing woven slide fastener stringers, disclosed in U.S. Pat. No. 3,827,463 patented Aug. 6, 1974, has a weft inserter which is angularly reciprocable across a conical orbital path of a monofilament and a plurality of wrap threads for inserting a weft thread in a warp shed. When the weft inserter starts traversing the monofilament so as to place the weft thread in the warp shed, the weft thread is likely to be engaged by the monofilament and to force the latter out of the path of insertion of the weft thread. Therefore, the weft thread is subjected to high tension and tends to be broken on being inserted in the shed. With such a difficulty, the apparatus cannot operate at high speeds.

SUMMARY OF THE INVENTION

A weft inserter reciprocable across a warp shed and a conical monofilament orbit for inserting a weft thread into the warp shed includes an arm engageable upon weft insertion with a monofilament while revolving in the orbit to displace the monofilament out of the path of insertion of the weft thread for allowing the latter to be inserted unobstructedly.

It is an object of the present invention to provide an apparatus for manufacturing woven slide fastener stringers, which includes a weft inserter for inserting a weft thread into warp sheds at a high speed without breaking or otherwise damaging the weft thread.

Another object of the present invention is to provide an apparatus for manufacturing woven slide fastener stringers, which includes a weft inserter having means for assisting a monofilament in being formed or coiled into coupling elements.

Still another object of the present invention is to provide a weft inserter of the type described which is simple in structure and applicable to existing apparatus for manufacturing slide fastener stringers.

Many other advantages, features and additional objects of the present invention will become manifest to those versed in the art upon making reference to the detailed description and the accompanying drawings in which a preferred structural embodiment incorporating the principles of the present invention is shown by way of illustrative example.

DETAILED DESCRIPTION

Figure 1:
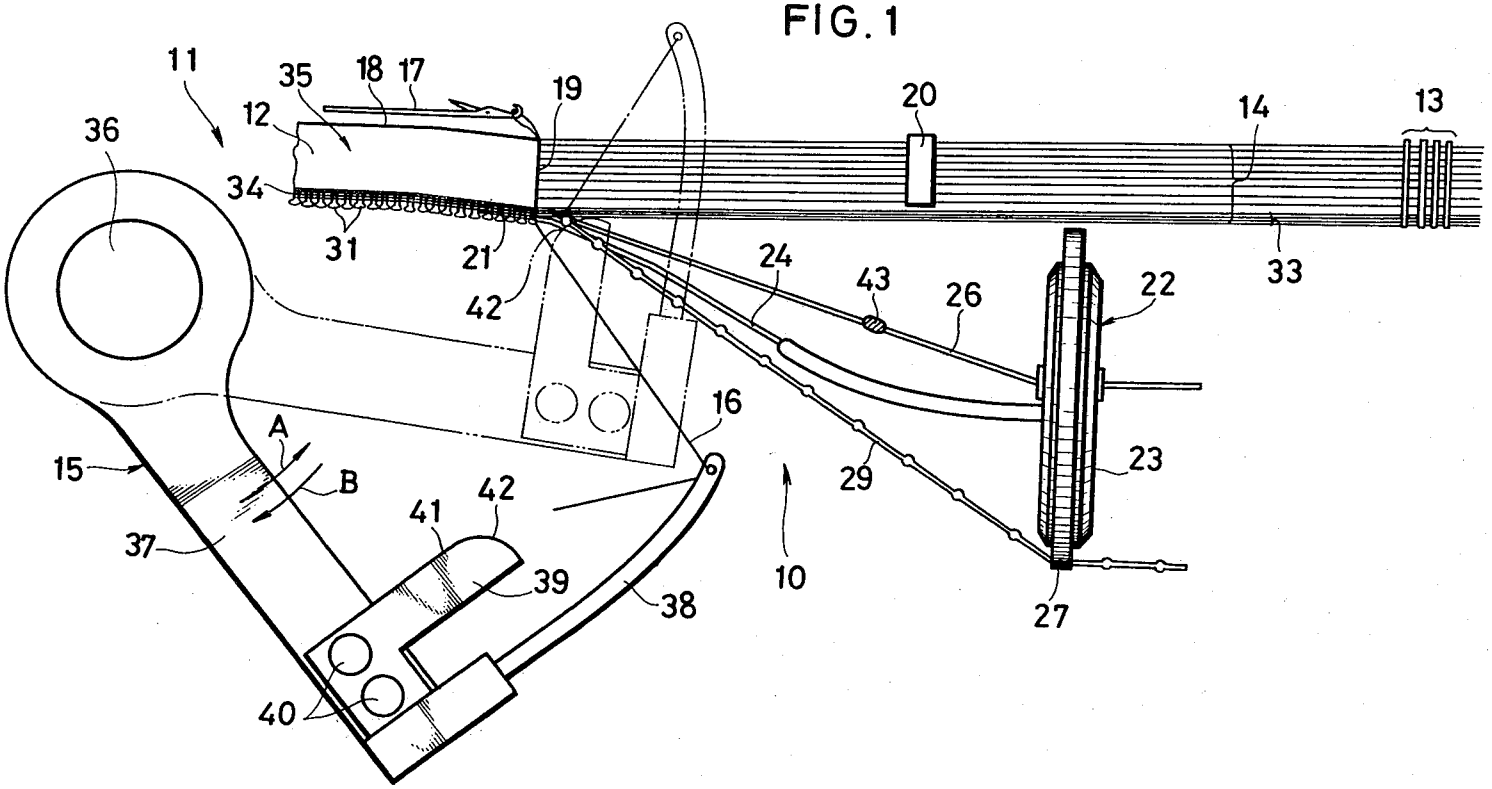
FIG. 1 is a schematic plan view of an apparatus for manufacturing slide fastener stringers, constructed in accordance with the present invention.

As shown in FIG. 1, an apparatus 10 according to the present invention comprises a needle loom 11 of a known construction for producing a narrow, continuous slide fastener stringer tape 12. The loom 11 includes a plurality of harnesses 13 for selectively raising and lowering a plurality of warp threads 14 to form successive warp sheds 14*a* (FIGS. 2–5), weft inserter 15 angularly movable back and forth to insert a weft thread 16 in the warp sheds 14*a*, a latch needle 17 reciprocable warpwise alongside of a longitudinal edge of the tape 12 for knitting the weft thread 16 projecting out of the shed 14*a* to form a tape selvage 18, and a reed 20 movable back and forth warpwise in the shed 14*a* for beating the inserted weft thread 16 into the fell 19 of the tape 12 being woven.

Figure 2:
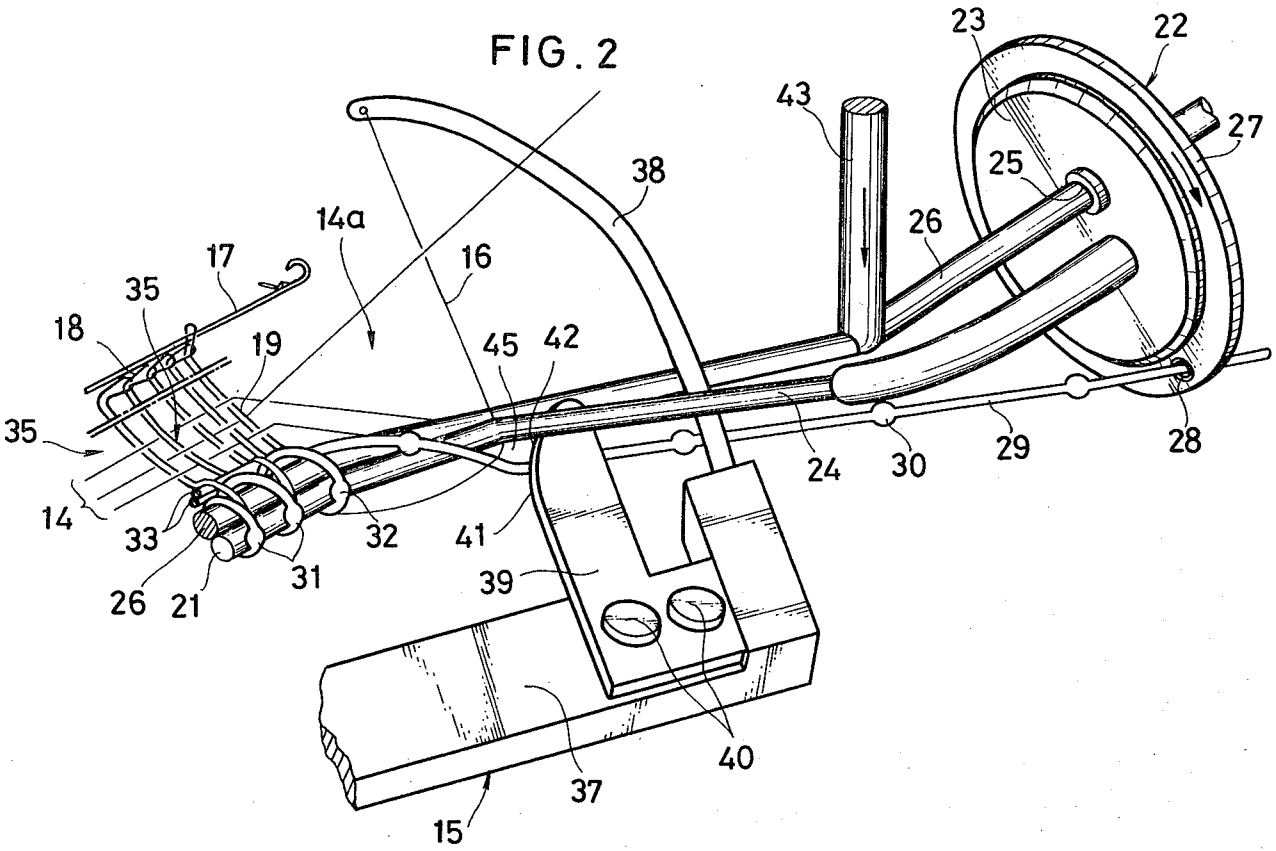
FIG. 2 is an enlarged fragmentary perspective view of the apparatus shown in FIG. 1.

As illustrated in FIGS. 1 and 2, a coiling mechanism 22 disposed alongside of the warp threads 14 includes a circular stator 23 which is stationary and non-rotatable, and supports a mandrel 24 extending substantially along the warp threads 14 toward the tape fell 19 and having a distal end portion 21 extending beyond the fell 19. The circular stator 23 has a hole 25 through which a core thread 26 is supplied. An annular rotor 27 is rotatably mounted around the circular stator 23 and has a hole 28 for passage therethrough of a monofilament 29 of synthetic resin, the annular rotor 27 being drivable by a suitable drive mechanism (not shown) to rotate the monofilament 29 around the mandrel 24 in a conical orbit. The monofilament 29 has a plurality of equally spaced flattened portions 30 which, when the monofilament 29 is coiled around the mandrel 24 into a row of successive coiled coupling elements 31, serve as coupling heads 32 for the coupling elements 31, as best illustrated in FIG. 2. As the coiled coupling elements 31 are successively formed, the core thread 26 is introduced therein and a group of warp threads 33 cooperate with the weft thread 16 in securing the coiled coupling elements 31 on and along a longitudinal edge 34 of the stringer tape 12. The stringer tape 12 and the row of coupling elements 31 thus woven into the tape 12 constitute a woven slide fastener stringer 35.

Figure 4:
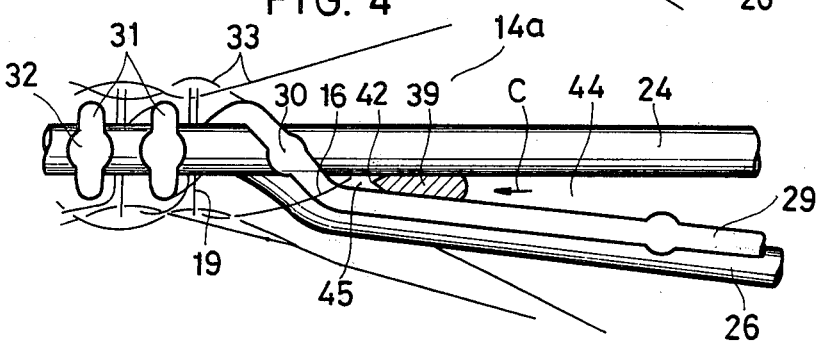

The weft inserter 15 comprises a shaft 36 angularly movable about its own axis, a lever 37 fixed to the shaft 36 for angular movement, and an arcuate weft finger or needle 38 mounted at a distal end of the lever 37 for carrying the weft thread 16 and reciprocable across the conical orbit of the monofilament 29 and the shed 14*a* for inserting the weft thread 16 into the shed 14*a*. An L-shaped arm 39 is mounted on the lever 37 by a pair of screws 50 at a position between the shaft 36 and the finger 38 and extends substantially parallel to the weft finger 38. As best shown in FIG. 4, the arm 39 is wedge-shaped in cross section and has a side edge 41 disposed away from the weft finger 38 and a rounded frontal edge 42 blending with the side edge 41.

Figure 3:
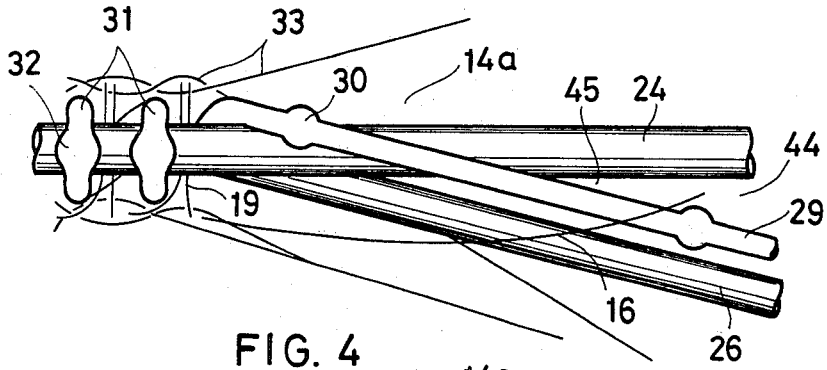
FIGS. 3 through 5 are enlarged fragmentary side elevational views showing progressive steps of inserting a weft thread into a warp shed.

Operation of the apparatus 10 is as follows: When the monofilament 29 is located as shown in FIG. 3 in its revolving movement about the mandrel 24 to form a coupling element next to the last coupling element 31, the weft inserter 15 starts moving in the direction of the arrow A (FIG. 1) to place the weft thread 16 into the warp shed 14*a* through a space 44 between the mandrel 24 and the monofilament 29 therebeneath. At this time, the core thread 26 is depressed by a presser 43 (FIG. 2) so as to be out of the path of movement of the weft finger 38. Upon angular movement of the weft inserter 15, the arm 39 moves therewith and starts wedging at its edges 41,42 in between the mandrel 24 and the monofilament 29 and core thread 26 in the direction of the arrow C (FIG. 4), whereupon the monofilament 29 and the core thread 26 are depressed out of the path of insertion of the weft thread 16, and at the same time the monofilament 29 is pushed by the frontal edge 42 of the arm 39 in the direction in which the monofilament 29 revolves in a conical orbit. The weft inserter 15 thus wedged in provides a space 45 at its frontal edge 42 between the mandrel 24 and the monofilament 29 and core thread 26, allowing the weft thread 16 to be fully inserted in the warp shed 14*a* through the space 45 unobstructedly. At this time, the frontal edge 41 of the arm 39 is located in front of the fell 19 of the stringer tape 12. Therefore, the weft thread 16 can smoothly be placed in the warp shed 14*a* without interference or frictional engagement with the monofilament 29 and the core thread 26 and hence without breakage or being otherwise damaged. In addition, the wedging movement of the arm 39 assists the monofilament 29 in being formed or coiled on the mandrel 24 into a coupling element 31.

Figure 5:
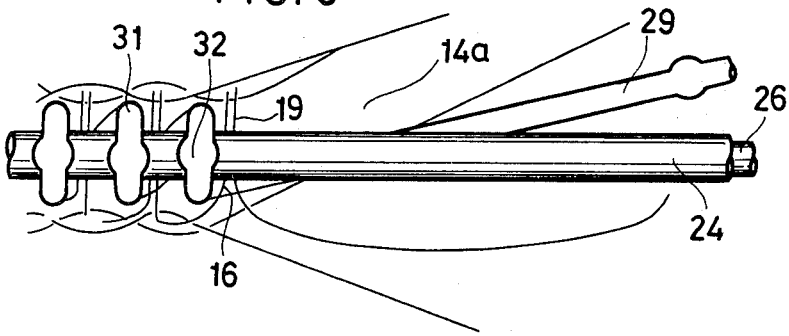

After having effected the pick insertion, the weft inserter 15 is angularly moved back in the direction of the arrow B (FIG. 1) to retract the finger 38 and arm 39 as the monofilament 29 continues revolving around the mandrel 24 and the core thread 26 as shown in FIG. 5.

Although various minor modifications might be suggested by those versed in the art, it should be understood that I wish to embody within the scope of the patent warranted hereon, all such embodiments as reasonably and properly come within the scope of my contribution to the art.

What is claimed is:

1. An apparatus for manufacturing woven slide fastener stringers, comprising:

(a) means for forming successive sheds with a plurality of warp threads;

(b) a coiling mechanism including a mandrel for extending substantially along the warp threads on one side thereof and a rotor for revolving a monofilament of synthetic resin around said mandrel in a conical orbit to form a series of coiled coupling elements; and (c) a weft inserter disposed on said one side of the warp threads and reciprocable across the conical orbit and one of the sheds at a time for inserting a weft thread into the shed, by which the coiled coupling elements can be woven into a stringer tape along a longitudinal edge thereof as the tape is woven of the warp and weft threads, said weft inserter including an arm movable upon weft insertion in between said mandrel and the monofilament and engageable with the monofilament being coiled to displace the latter out of the path of insertion of the weft thread for allowing the latter to be inserted unobstructedly.

2. An apparatus according to claim 1, said weft inserter comprising a shaft angularly movable on its own axis, a lever fixed to said shaft, and a finger attached to said lever for carrying the weft thread, said arm being fixed to said lever at a position between said shaft and said finger and extending substantially parallel to said finger, said arm having an edge locatable in front of the fell of the stringer tape when the weft inserter is in a position to fully insert the weft thread into the shed.

3. An apparatus according to claim 1, said arm being wedge-shaped in cross section.

* * * * *